US007488176B2

(12) United States Patent
Erdoss et al.

(10) Patent No.: US 7,488,176 B2
(45) Date of Patent: Feb. 10, 2009

(54) MOVABLE OPERATION SUPPORT SYSTEM FOR SHOTGUN SHOOTING LEARNING, GAMES, AND COMPETITION

(76) Inventors: Vasile Erdoss, 3325 Cypress Club Trail, Austell, GA (US) 30106; Andrei Erdoss, 3325 Cypress Club Trail, Austell, GA (US) 30106

( * ) Notice: Subject to any disclaimer, the term of this patent is extended or adjusted under 35 U.S.C. 154(b) by 719 days.

(21) Appl. No.: 10/863,598

(22) Filed: Jun. 8, 2004

(65) Prior Publication Data

US 2005/0282118 A1 Dec. 22, 2005

(51) Int. Cl.
*F41A 33/00* (2006.01)

(52) U.S. Cl. ..... 434/16; 280/47.17; 124/8; 124/34; 463/16

(58) Field of Classification Search ..... 463/16–19; 273/348; 124/8, 34; 212/901; 410/51; D32/16
See application file for complete search history.

(56) References Cited

U.S. PATENT DOCUMENTS 2,855,916 A * 10/1958 Foster ..... 124/32
3,286,890 A * 11/1966 Hildebrandt ..... 224/241
3,908,992 A * 9/1975 Cunningham et al. ..... 473/477
6,039,332 A * 3/2000 Austin ..... 280/47.17
6,752,404 B1 * 6/2004 Blake ..... 280/47.27

* cited by examiner

*Primary Examiner*—Xuan M. Thai
*Assistant Examiner*—Kesha Y. Frisby

(57) ABSTRACT

The present invention discloses a movable operation support system, used in clay target shotgun shooting learning, games and competition, which can be set up and operated in any location of the field. A preferred embodiment of the system is composed of a mobile support device used to transport in any position of the shooting field a multi-target release control panel, a portable safety screen that is carried, positioned at each shooting station to assure safety of the shooting, a plurality of mutable station indicators that can be placed randomly on the course and a release cable assembly that connects the clay target throwing machines to the multi-target release control panel. Further a pivoting arm clears the way for the mobile support device by guiding the cables. Additionally a hulls collection box is attached to the portable safety screen and the mobile support device, helping to maintain a clean field.

1 Claim, 8 Drawing Sheets

MOVABLE OPERATION SUPPORT SYSTEM FOR SHOTGUN SHOOTING LEARNING, GAMES, AND COMPETITION

CROSS-REFERENCE TO RELATED APPLICATIONS

Not applicable.

STATEMENT REGARDING FEDERALLY SPONSORED RESEARCH OR DEVELOPMENT

Not applicable.

BACKGROUND

1. Field of Invention

This invention is related to clay target shotgun shooting learning, games and competition.

In Particular it Relates to:

(a) Operation support systems composed of devices that provide functionality for shotgun shooting learning, games and competition. The Movable Operation Support System, presented in this invention is composed of a mobile support device for a multi-target release control panel, a portable safety screen, a mutable shooting station indicator and a release cable assembly.

2. Description of Prior Art

Clay target shotgun games were invented with the purpose of imitating small game hunting. These games use an operation support system composed of: a number of clay target throwing machines, clay target release mechanisms, a number of shooting stations, a number of constructions and a number of safety cages. These elements of the operation support system used in the simplest game, such as American Trap to the most complex, such as Sporting Clays, are in general immobile and of a fixed nature. In some shotgun shooting games the clay target throwing machines are placed in permanent buildings, such as American Skeet, American Trap, and Bunker.

For all these games, the shooting stations position is predetermined and fixed, which requires that the shooting happen from the same location every time, such as in American Skeet, American Trap, Bunker, 5 Stand and Sporting Clays. Some games use constructions and permanent safety cages, built on shooting stations, which further restricts the target presentations available for the shooter, such as 5 Stand and Sporting Clays.

The clay target release control mechanism, single or multi target, for most of the shotgun shooting games is placed in a central and fixed position. Due to the immobility of the target release control mechanism, course builders are forced to put the shooting stations close to one another, in order for the operator of the game to hear the shooter's calls for target(s), such as in American Trap, 5 Stand. In other instances, an intermediary person is used to facilitate the communication between the shooter(s) and the game operator. This breaks the flow of the game and can produce a lot of confusion, such as in FITASC.

The above description highlights the fixed nature of the components of the operation support systems of these games. Due to this characteristic, clay targets presentations are similar and predictable and the games become routine and boring.

The games that provide more variety of target presentations also use a larger area of land, a greater number of target throwing machines and constructions, such as towers, shooting stations, safety cages, which raise the cost of operation, maintenance and in the end the cost of playing the game, such as FITASC, Sporting Clays, 5 Stand.

The course of some of the games is placed in wooded areas, thus the other shooters and the public cannot follow the competition entirely due to the low visibility of the clay targets presentations, such as Sporting Clays, FITASC.

SUMMARY

In accordance with the present invention a movable operation support system comprises of a mobile support device for a multi-target release control panel, portable safety screen, a mutable station indicator and a release cable assembly.

The mobile support device is comprised of a support base, a hulls deposit box, a frame made up of structural columns, structural strips, and two maneuvering handles, two wheels, a wheel axle, arched bars, a cable directing assembly made up of a U-bolt, a pivot axle, bearing, a pivoting arm, an anchor hook, and a protective stopper, a board, a pronged grill, a scoreboard support made up of two posterior legs, two anterior legs, a posterior beam, and an anterior beam.

The multi-target release control panel is comprised of release heads for each clay target throwing machine.

The portable safety screen is comprised of support plates, vertical beams, insertion hole, extension pole, horizontal beam, positioning stick, carrying handle, pin, and a collection box.

The mutable station indicator is comprised of a plate and in ground tips placed at the bottom of the plate. The plate is divided in three areas. The top area shows a station number, the middle area shows the alignment guideline for the portable safety screen and has a positioning hole, and the bottom area shows the shooting sequence and the target throwing machines sequence.

The release cable assembly is comprised of machine cables, an anchoring pole, a collective cable, plug cables, connection plugs and head cables.

OBJECTS AND ADVANTAGES

Accordingly, besides the objects and advantages of the movable operation support system for shotgun shooting learning, games described in my above patent, several objects and advantages of the invention are:

(a) To provide a movable operation support system, composed of a mobile support device for a multi-target release control panel, a portable safety screen, a mutable station indicator and a release cable assembly, which can be set up and operated in any location of the field. Due to its mobility, the movable operation support system provides the possibility of an unlimited number of target presentations, different by angle, direction and distance, thus allowing the shooter to shoot upon each clay target from each clay target throwing machine from any position in the shooting field.

(b) To provide a mobile support device for transporting the multi-target release control panel, thus facilitating the communication between operator and shooter. The operator is able to move the mobile support device from shooting station to shooting station and to launch any clay target from any clay target throwing machine placed in the field, at the preference of the shooter.

(c) To provide a portable safety screen that can be moved and positioned from shooting station to shooting station and that limits the shooting action to a safe designated area for each shooting station. Due to its portability, the safety screen doesn't abstruse the shooting field, thus permitting the movement of the mobile support device.

(d) To provide mutable station indicators that can be placed in any point of the shooting field and that permit the reconfiguration of the shooting course layout, without much difficulty. They also align with the portable safety screen in order to provide consistency in placement of the portable safety screen and ensure safety.

(e) To provide a release cable assembly that connects the clay target throwing machines to a multi-target release control panel and that groups all the cables into one collective cable that is long enough to reach any point in the field.

(g) To provide a movable operation support system that makes possible the creation of a variety of clay target presentations useful in clay target games and instruction.

(h) To encourage the creation of a variety of new shotgun shooting games with low operating and maintenance costs.

Further objects and advantages of my invention will become apparent from a consideration of the drawings and ensuing description.

DRAWINGS FIGURES

DESCRIPTION—FIGS. 1 THROUGH 8—PREFERRED EMBODIMENT

Figure 8:
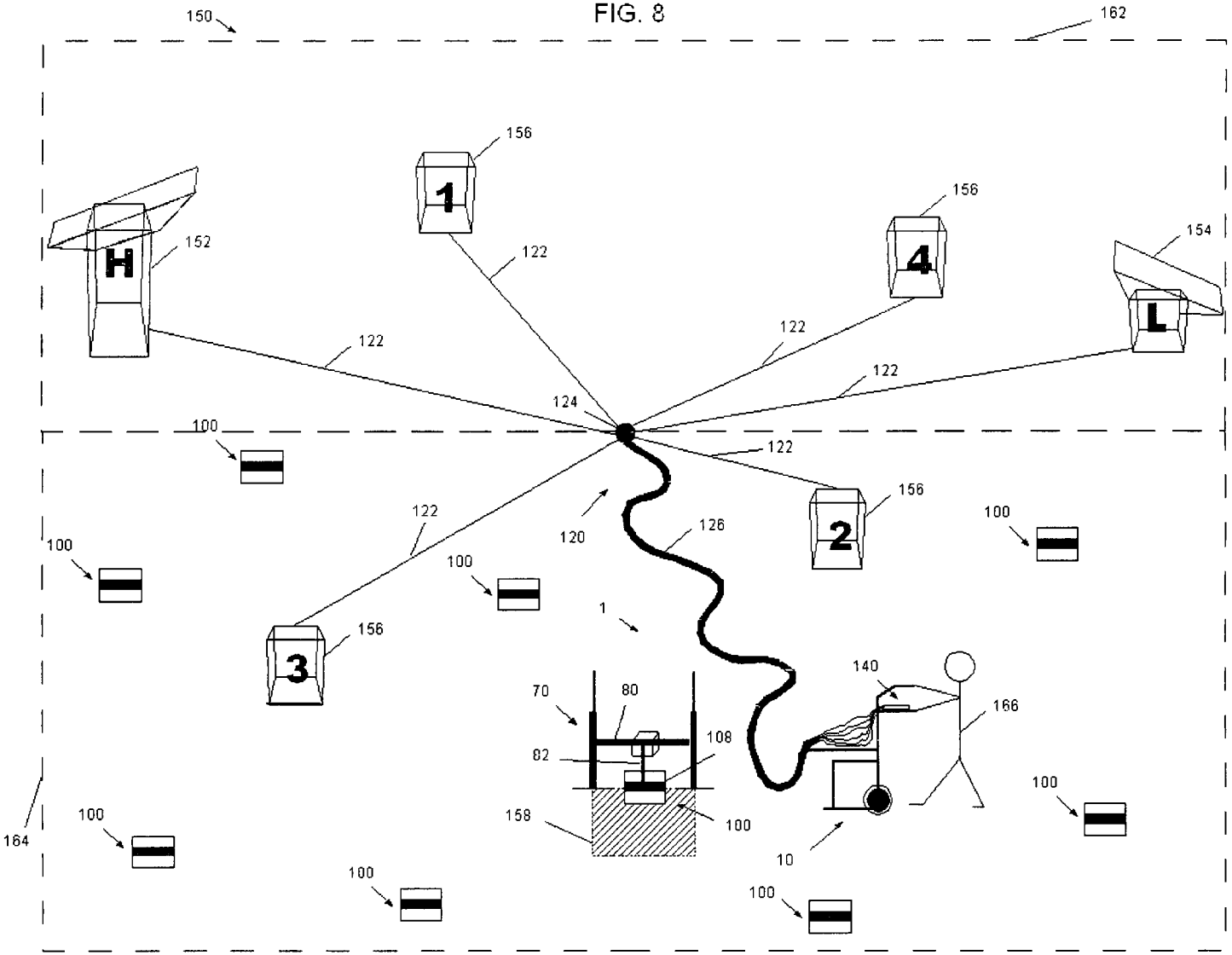
FIG. 8 shows a preferred embodiment of a movable operation support system on a field in a plan view.

The preferred embodiment of this invention, shown in plan view in FIG. 8, is comprised of a movable operation support system for a new clay target shotgun shooting game, using a wired release system used on a course or Skeet field 150. The movable operation support system 1 is composed of a mobile support device 10 for a multi-target release control panel 140 using man-power propulsion, a portable safety screen 70, mutable station indicators 100 and a release cable assembly 120.

Figure 1:
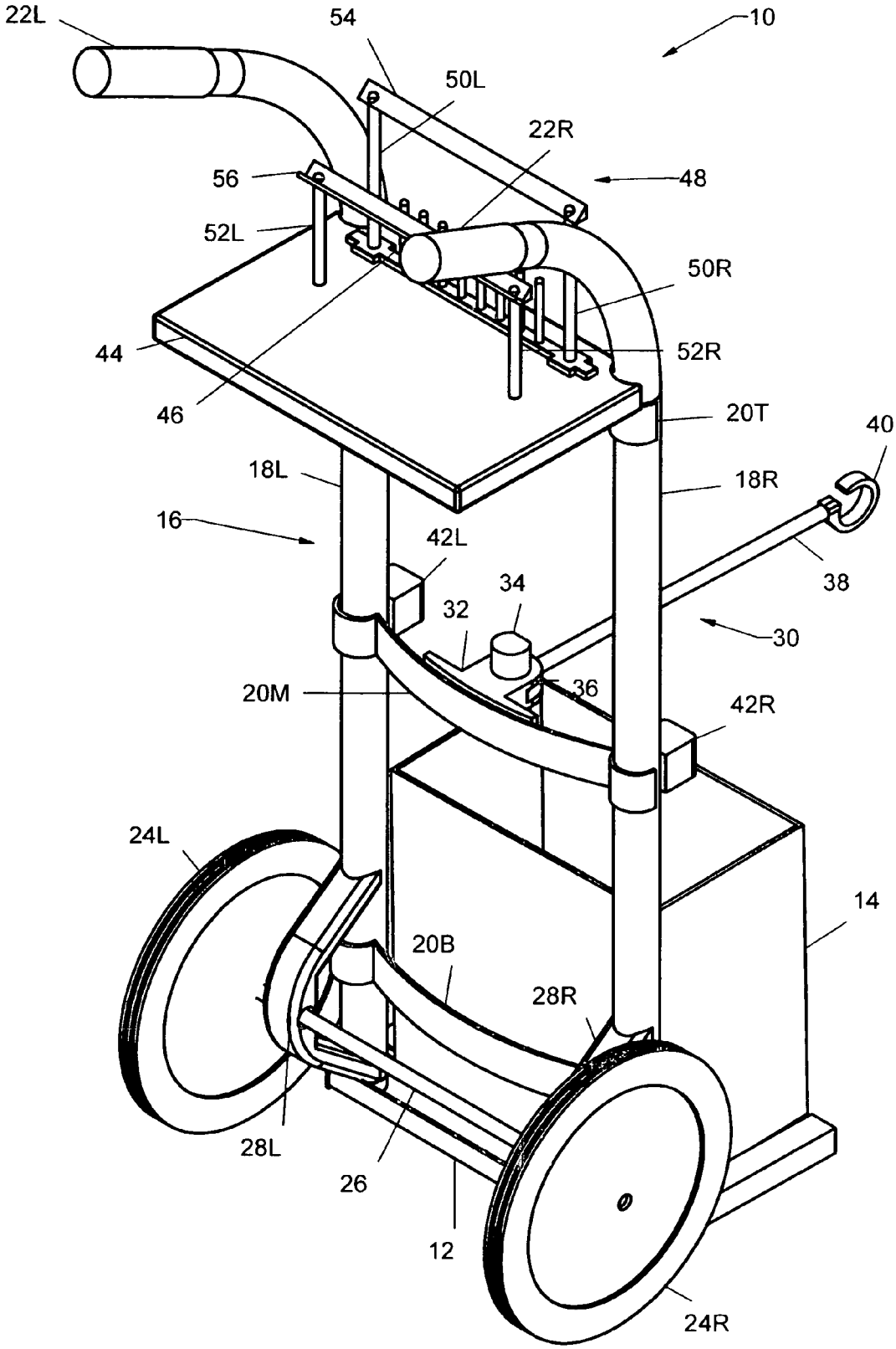
FIG. 1 shows a preferred embodiment of a mobile support device for a multi-target release control panel (shown in FIG. 7) from rear side view.
Figure 7:
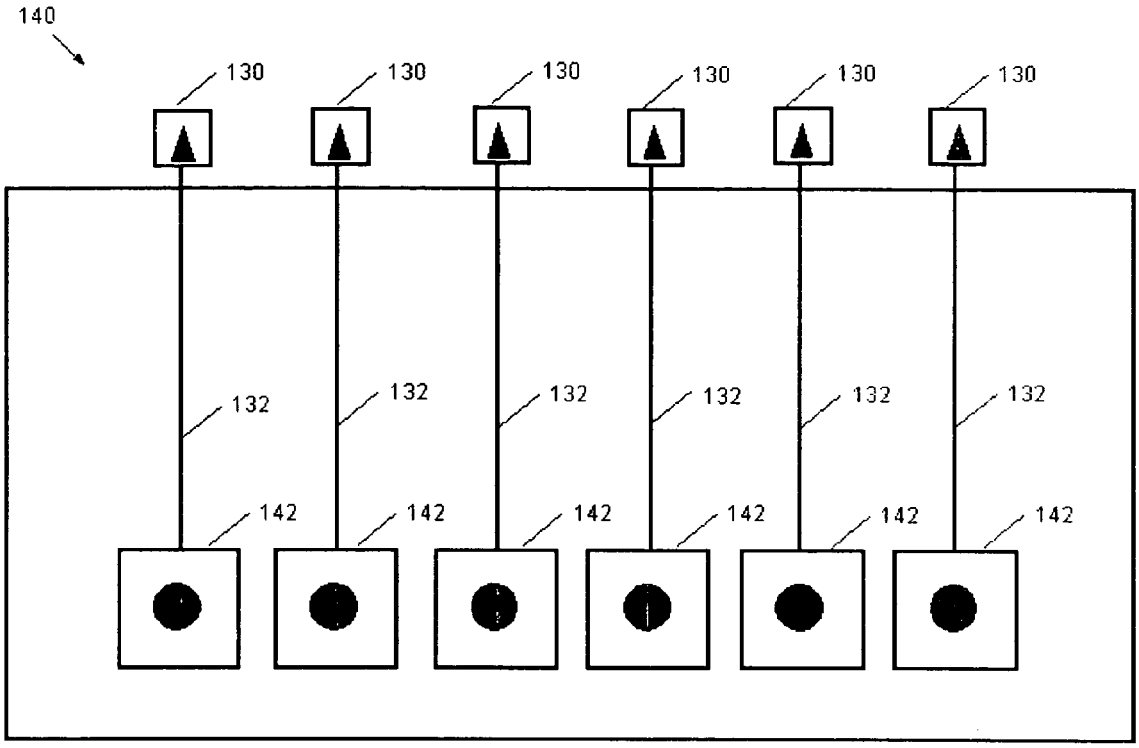
FIG. 7 shows a preferred embodiment of a multi-target release control panel in a top view.

FIG. 1 shows the mobile support device 10 for the multi-target release control panel 140 (shown in FIG. 7) in a rear side view. The function of the mobile support device 10 is to transport the multi-target release control panel 140 (shown in FIG. 7) in any point of the field 150 (shown in FIG. 8). The mobile support device 10 is composed of:

a) A support base 12 that has a hull deposit box 14 that can be attached/detached.

b) Two structural columns 18R, 18L that are connected with three structural strips 20B (Bottom), 20M (Middle), 20T (Top) and which form the frame 16 of the mobile support device 10.

c) Two maneuvering handles 22L, 22R that terminate the two structural columns 18L, 18R and are used to maneuver the mobile support device 10 in any direction of the field 150 (shown in FIG. 8).

d) Two wheels 24L, 24R on a wheel axle 26 that are attached to the frame 16 through two arched bars 28L, 28R.

e) A cable directing assembly 30, placed on the structural strip 20M. The cable directing assembly 30 is composed of a U-bolt 32, a pivot axle 34, a bearing 36, a pivoting arm 38, an anchoring hook 40 and has the function of guiding a collective cable 126 (shown in FIG. 6) in both sides of the mobile support device 10, left and right, in order to clear the way.

f) Two protective stoppers 42L, 42R placed on the two structural columns 18L, 18R at the same level as the pivoting arm 38 of the cable directing assembly 30. The two protective stoppers 42L, 42R have the function of amortizing the impact of the pivoting arm 38 against the columns 18L, 18R.

g) A board 44 placed on the structural strip 20T and the two structural columns 18L, 18R that has the function of supporting the multi-target release control panel (shown in FIG. 7). A pronged grille 46 is placed at the front of the board 44, with the function of separating and holding in place the release heads (shown in FIG. 7). A scoreboard support 48 is composed of two posterior legs 50L, 50R, two anterior legs 52L, 52R, a posterior beam 54, anterior beam 56 and is placed on top of the board 44.

Figure 2:
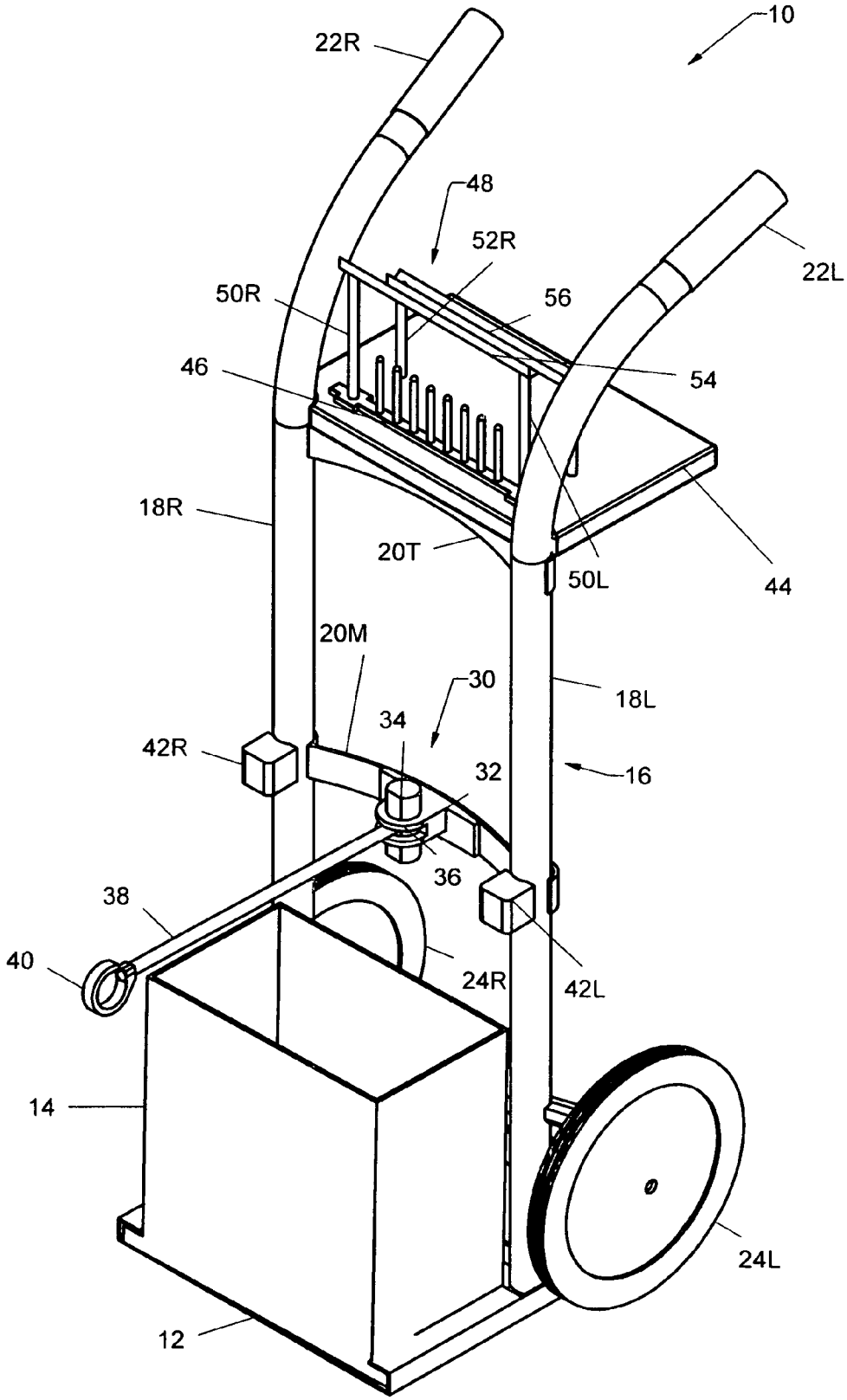
FIG. 2 shows the same mobile support device as in FIG. 1 from front side view.

FIG. 2 shows the mobile support device 10 for the multi-target release control panel 140 (shown in FIG. 7) in a front side view.

Figure 3:
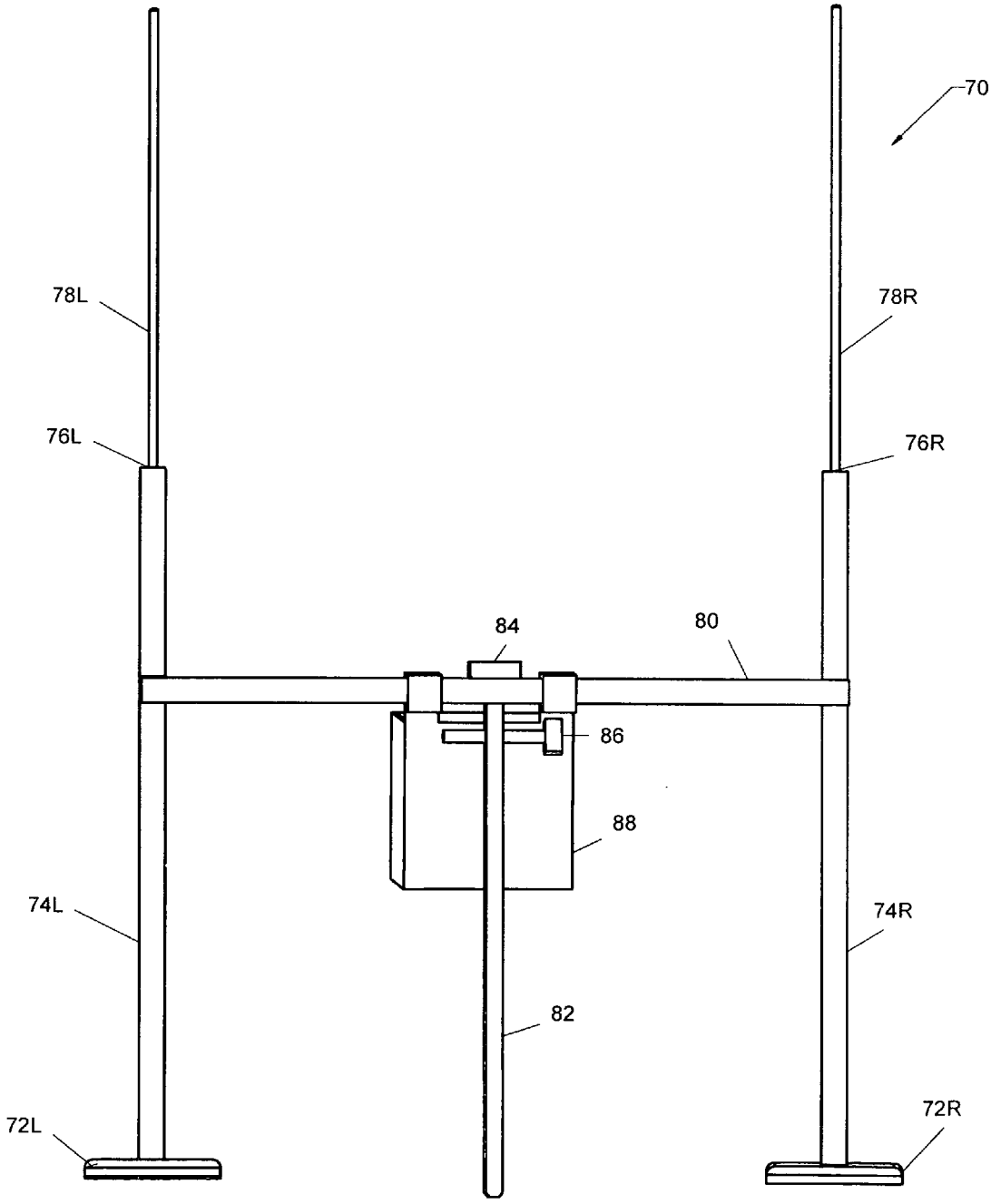
FIG. 3 shows a preferred embodiment of a portable safety screen in a rear view.

FIG. 3 shows the portable safety screen 70 in a rear view. The function of the portable safety screen 70 is to delimit the range of motion of the shotgun, in order to provide safety.

The Portable Safety Screen 70 is Composed of:

a) Two support plates 72L, 72R, offering stability for the portable safety screen.

b) Two vertical beams 74L, 74R placed on top of the support plates 72L, 72R. The beams 74L, 74R at the top end have an insertion hole 76L, 76R.

c) Two extension poles 78L, 78R are inserted into vertical beams 741, 74R through the insertion holes 76L, 76R. These poles 78L, 78R are removable in order to facilitate the portability of the portable safety screen.

d) A horizontal beam 80 that connects the two vertical beams 74L, 74R. This beam 80 limits the body position of the shooter and supports the collection hulls box 88 and the positioning stick 82 which has a pin 86.

Figure 4:
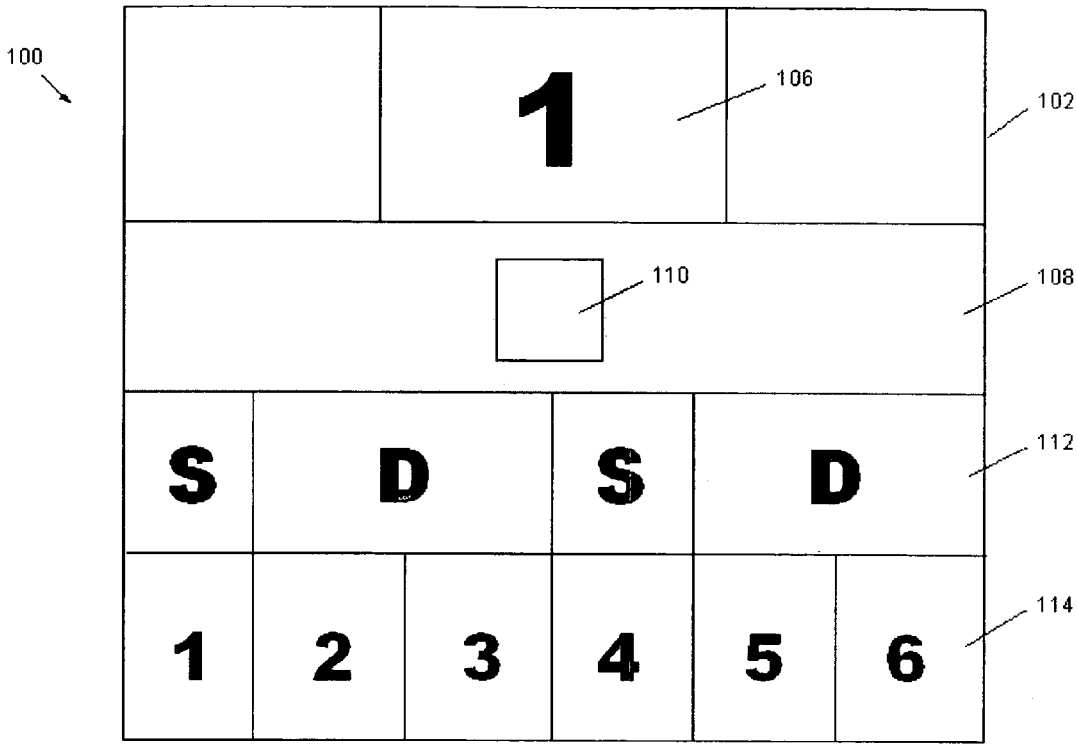
FIG. 4 shows a preferred embodiment of a mutable station indicator in a top view.

FIG. 4 shows the mutable station indicator 100 in top view. The function of the mutable station indicator 100 is to mark the position of a station square 158 (shown in FIG. 8) on the field 150 (shown in FIG. 8) and to align the portable safety screen 70. The mutable station indicator 100 is composed of:

a) A plate 102 placed temporarily on the ground, and held in place with the help of in ground tips 104 (shown FIG. 5), b) The plate 102 is divided in three areas. Top area contains the station number 106. Middle area contains a safety guideline 108 and a positioning hole 110 for the portable safety screen 70. Bottom area contains the shooting sequence diagram 112 of the game and the target throwing machines sequence 114.

Figure 5:
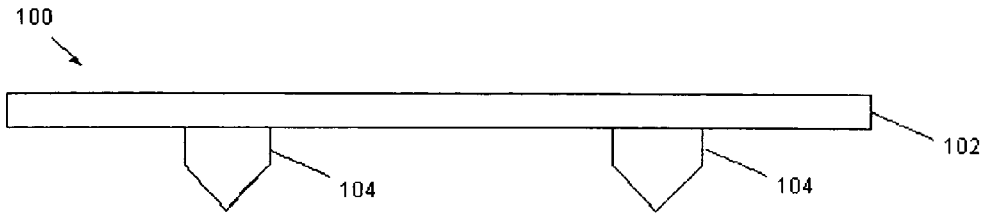
FIG. 5 shows the same mutable station indicator in a profile view.

FIG. 5 shows the mutable shooting indicator 100 in profile view. This view shows a plate 102 and two in ground tips 104.

Figure 6:
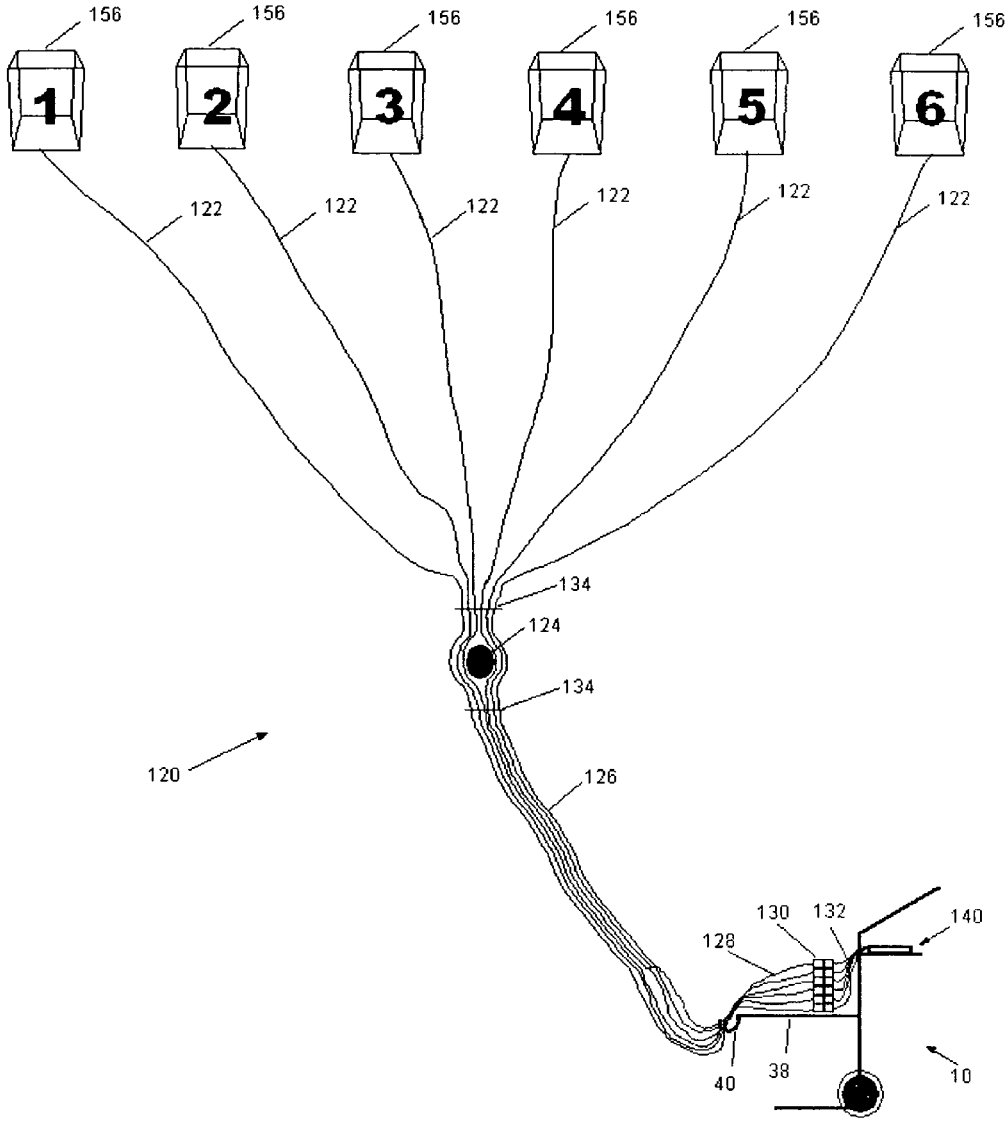
FIG. 6 shows a preferred embodiment of a release cable assembly, target throwing machines and the mobile support device for a multi-target release control panel in a plan view.

FIG. 6 shows the release cable assembly 120 in a plan view. All machine cables 122 coming from the clay target throwing machines 156 are joined together using cable ties 134 to form a collective cable 126 that pivots at one end around an anchoring pole 124. The other end of the collective cable 126 is hanged on an anchoring hook 40 of a pivoting arm 38 of the mobile support device 10. The pivoting arm 38 of mobile support device 10 orients the collective cable 126 in order to clear the way for the mobile support device 10. From the anchoring hook 40 the collective cable 126 is separated into single plug cables 128. Each one of these plug cables 128 is connected through a connection plug 130 with a head cable 132 that terminates into a release head 142 (shown in FIG. 7).

FIG. 7 shows the multi-target release control panel 140 in top view, composed of all release heads 142 and head cables 132.

FIG. 8 shows the preferred embodiment of the movable operation support system 1 as incorporated in a shooting game in a plan view. This game uses the two existing clay target throwing machines 156, placed in the High House 152 and the Low House 154 of a Skeet field 150, such that it incorporates existing infrastructure, thus lowering the building costs of a new course. Additionally, the game uses a number of clay target throwing machines 156 placed randomly inside the perimeter of the shooting course 150. The positioning of the clay target throwing machines 156 is such that the clay targets are projected toward the shooting area 162. The clay target throwing machines 156 are not permanent fixtures, thus they can be repositioned and reoriented in order to give different levels of difficulty for shooters. They are positioned under, on the, or above the ground level on towers of different heights. These machines 156 can throw different size and shape clay targets, in order to create variety and excitement for the shooters and the public watching.

Stations squares 158 are areas inside the station placement area 164 where the shooter takes aim at the clay targets thrown by the machines 156 and are identified by the randomly placed mutable station indicators 100. The station squares 158 have a side as long as the horizontal beam 80 of the portable safety screen 70. The horizontal beam 80 is aligned with a mutable station indicator's 100 safety guideline 108 using a positioning stick 82 of the portable safety screen 70.

In this wired preferred embodiment of the movable operation support system 1 the clay target throwing machines 156 are connected to the mobile support device for a multi-target release control panel 10 through the release cable assembly 120. The collective cable 126, which is part of the release cable assembly 120, has a length long enough such that it can reach any point inside the course 150 perimeter.

The stick FIG. 166 behind the mobile support device for a multi-target release control panel 10 represents the operator of the game.

Operation—FIGS. 1 Through 8—Preferred Embodiment

The functionality of the movable operation support system results from the combined usages of its components. First of all the operator of the game sets up the shooting field 150, by randomly placing clay target throwing machines 156 in the field 150 and mutable station indicators 100 in the station placement area 164.

The Station Square 158 is Activated in the Following Manner:

The operator 166 removes the pin 86 of the portable safety screen in order to release the positioning stick 82. Next the operator 166 aligns the portable safety screen 70 with the mutable station indicator 100 by matching the positioning stick 82 with the mutable station indicator's 100 positioning hole 110.

The operator 166 places the mobile support device for the multi-target release control panel 10 behind the station square 158. The moving of the mobile support device 10 is done by inclining the device from its vertical upright position to an oblique stance and pushing it forward. The direction of the device is changed by applying greater pushing force to the opposite side from where the turning is to take place. At the same time, the pivoting arm 38 of the mobile support device 10, guides the collective cable 126, clearing the way for the mobile support device 10.

At the call of the shooter, the operator 166 can release each clay target from each clay target throwing machine 156 in the field 150.

The Station Square 158 is Deactivated in the Following Manner:

After one shooting action is complete, the shooter throws the empty hulls into the collection box 88 that is attached to the portable safety screen 70.

After the shooting action has ended on this station square 158, the operator 166 lifts up the collection box 88 from the horizontal beam 80 of the portable safety screen 70 and he empties it into the deposit box 14, found at the support base 12 of the mobile support device 10.

Next, the operator 166 lifts the positioning stick 82 and removes the portable safety screen 70 from the current mutable station indicator 100. The operator 166 then inserts the pin 86 of the portable safety screen in order to secure the positioning stick 82.

The operator 166 then proceeds to place the portable safety screen 70 and to move the mobile support device 10 to the next station square 158. This procedure repeats for each shooting station square 158. At the end of the shooting game, the operator 166 slides out the deposit box 14 and empties it into another container (not shown).

Figure 9:
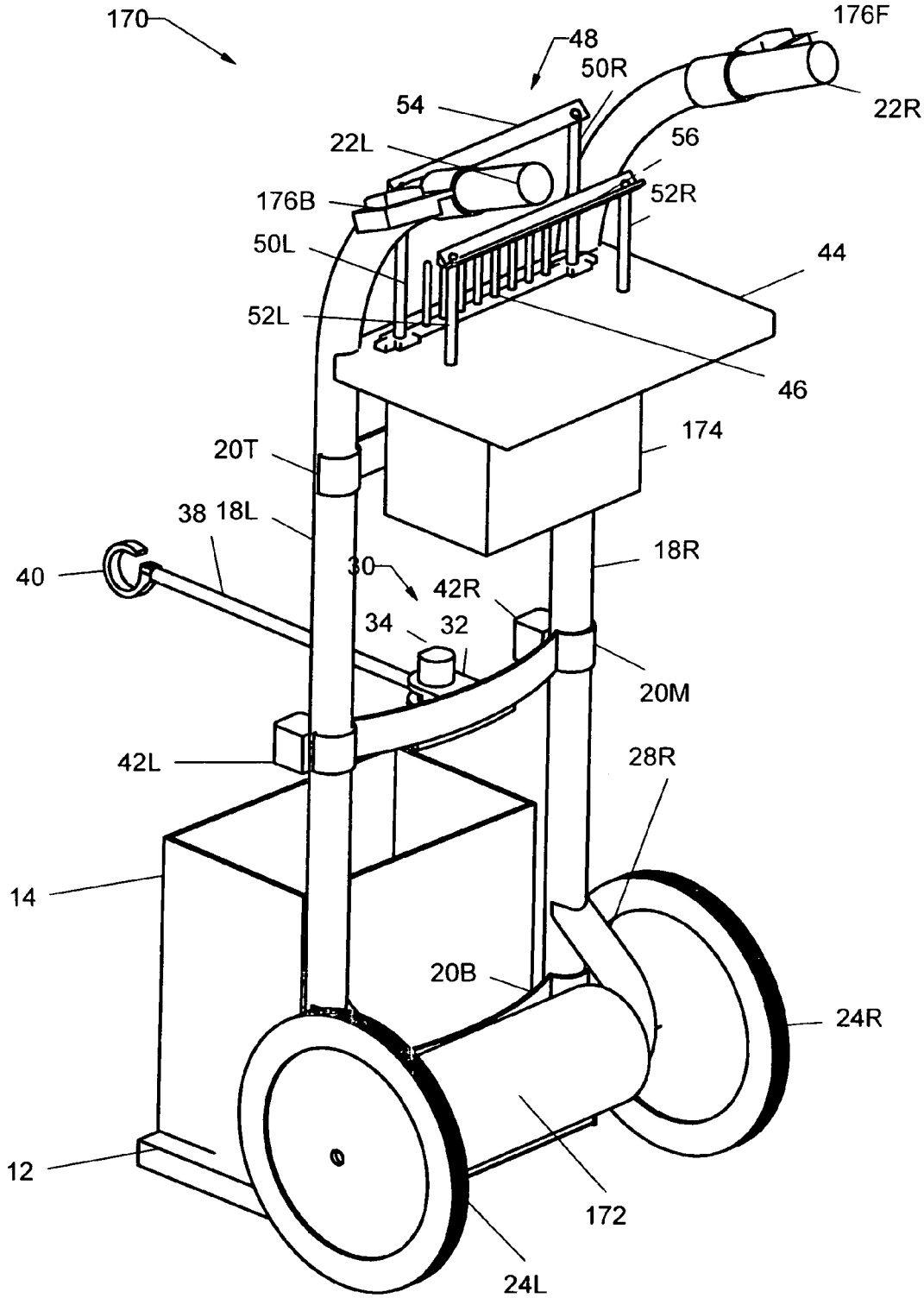
FIG. 9 shows an alternative embodiment of a mobile support device for a multi-target release control panel additionally having an electric motor, battery and directional buttons in a rear side view.

Description and Operation—FIGS. 9 and 10—Alternative Embodiments

FIG. 9 shows the mobile support device for a multi-target release control panel alternative embodiment 170 in a rear side view. This version has additionally:

a) An electric motor 172, used to replace manual propulsion with electrical propulsion.

b) An electrical rechargeable battery 174, as a power source for the electric motor 172.

c) Motion Buttons 176F (Forward), 176B (Backward), which are used to move the device 170, forward and backward.

The operator 166 (shown in FIG. 8) presses the motion button 176F to go forward and the motion button 176B to go backwards. This would case the movement of the mobile support device 170 and replace man power propulsion with electrical propulsion. FIG. 10 shows an alternative embodiment of the shooting course 180. This version has additionally:

CONCLUSION, RAMIFICATIONS, SCOPE OF INVENTION

It can be concluded that the mobility of the movable operation support system creates an unlimited variety of target presentations, in a safe environment. The movable operation support system can be used in teaching, games and competition for shotgun shooting, at a low construction, maintenance and operating cost.

Although the description above contains much specificity, these should not be construed as limiting the scope of the invention but as merely providing illustrations of some of the presently preferred embodiments of this invention. Many other variations are possible. For example, the release of the targets can be activated with the use of a microphone mounted on the mobile support device for a multi-target release control panel and plugged into a computer that controls the sequence of shooting, shooting station by shooting station. The computer is connected to each clay target throwing machine by the collective cable.

Another variation of the movable operation support system does not use cables to connect the clay target throwing machines and the release heads. A wireless system, whose command panel is carried by the mobile support device, is used to connect the release heads and the clay target throwing machines. In this variation, the cable directing assembly of the mobile support device for a multi-target release control panel is non-existing.

A variation for the station indicator is one where the number of the shooting station and the sequence of shooting can be marked down and later erased on a mark able and erasable surface. Another variation to the mutable station indicator is using a Velcro system to attach/detach the station number, sequence of shooting, and the clay target throwing machine sequence. This embodiment would facilitate changing the station number and sequence of shooting in order to create additional combinations of target presentations.

Thus the scope of the invention should be determined by the appended claims and their legal equivalents, rather than by the examples given.

What is claimed is:

1. A movable operation support system for creating a variety of shotgun shooting instances in safe shooting conditions used in learning, games, and competition comprising of:

(a) a mobile support device including a plurality of release controls from target throwing machines, and a scoreboard, wherein said plurality of release controls provide a shooter from a shooting location with a variety of target presentations by launching clay targets from different angles and distances from said target throwing machines and to keep score of the shooter's performance all by means of said mobile support device comprising of:

(i) a rectangular base platform in full contact with ground surface in stationary position, providing stability of said mobile support device, (ii) a rigid frame composed of a pair of vertical parallel bars, mounted perpendicularly lengthwise on top of said base on opposite corners, having a lower end near said base platform, a middle and an upper end, (iii) a pair of handles extending horizontally and rearwardly from said upper end of said frame whereby said operator by grasping said handles may propel said mobile support device, (iv) a set of three parallel metal bars disposed in a plane perpendicular to that of said vertical pair of bars mounted on said lower end, middle and upper end of said frame respectably, (v) a wheel axle mounted to the rear lower end of said frame, (vi) a pair of transversely spaced wheels mounted for displacement movement on said wheel axle ends, (vii) a release cable assembly guiding mechanism mounted forward-centrally on said middle bar so that to direct said release cable assembly away from the trajectory of said mobile support device, for which the release cable assembly permits a single field operator to transport to said randomly designated shooting location, on a Skeet and Trap shooting field combination or open field of similar size, comprised of:

(1) a pivoting arm presenting at its rear end a central axle concentrically positioned within an inner axle sleeve directly mounted to said middle bar and free to rotate therein, (2) an anchoring means for said cable assembly positioned at the front end of said pivoting arm, (3) a pair of movement limiting means for said pivoting arm, mounted forwardly on each said vertical parallel bar and in the same plane as said pivoting arm, (viii) a rectangular board mounted on upper end of said frame extending rearwardly in a plane perpendicular to that of said parallel vertical bars, presenting on top surface:

(1) a release cable pronged grille in proximity to said frame, forming a perpendicular plane to that of said rectangular board, (2) removably attachable containing means for said release controls of said target throwing machines, centrally located on said board, (3) a scoreboard attachment means mounted above said release controls containing means, and (b) a transportable safety screen to be positioned in said randomly designated shooting location, adjacent to said mobile support device, with purpose to limit gun muzzle movement to safe area of said shooting field during shooting action upon said target presentations, comprising of:

(i) a horizontal bar parallel to ground surface, (ii) a plurality of vertical parallel bars extending upwardly-perpendicular to said horizontal bar so that to efficiently limit gun muzzle movement, (iii) a plurality of vertical parallel bars extending downwardly perpendicular to said horizontal bar, provided at lower end with stability means.

* * * * *